US006822538B2

(12) United States Patent
Tsukamoto et al.

(10) Patent No.: US 6,822,538 B2
(45) Date of Patent: Nov. 23, 2004

(54) DIELECTRIC FILTER, DIELECTRIC DUPLEXER, AND COMMUNICATION APPARATUS INCORPORATING THE SAME

(75) Inventors: Hideki Tsukamoto, Ishikawa-ken (JP); Takahiro Okada, Ishikawa-ken (JP); Katsuhito Kuroda, Matto (JP); Jinsei Ishihara, Kanazawa (JP); Hideyuki Kato, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/265,741

(22) Filed: Oct. 8, 2002

(65) Prior Publication Data

US 2003/0025578 A1 Feb. 6, 2003

Related U.S. Application Data

(63) Continuation of application No. 09/687,903, filed on Oct. 13, 2000.

(30) Foreign Application Priority Data

Oct. 13, 1999 (JP) ..... 11-291578

(51) Int. Cl.[7] ..... H01P 1/20

(52) U.S. Cl. ..... 333/206; 333/134; 333/204; 333/222

(58) Field of Search ..... 333/134, 206, 333/222, 204

(56) References Cited

U.S. PATENT DOCUMENTS 4,371,853 A * 2/1983 Makimoto et al. ..... 333/204
4,506,241 A * 3/1985 Makimoto et al. ..... 333/222
5,525,946 A * 6/1996 Tsujiguchi et al. ..... 333/202
5,572,174 A * 11/1996 Kitaichi et al. ..... 333/206
5,612,654 A * 3/1997 Tsujiguchi et al. ..... 333/202
5,684,439 A * 11/1997 Vangala ..... 333/202
6,359,529 B1 * 3/2002 Tsunoda et al. ..... 333/204

FOREIGN PATENT DOCUMENTS

| | | |
|---|---|---|
| JP | 7-94911 | 4/1995 |
| JP | 8-330806 | 12/1996 |
| JP | 10-224111 | 8/1998 |
| JP | 10-256807 | 9/1998 |

OTHER PUBLICATIONS

Copy of Japanese Examination Report dated Oct. 28, 2003 (and English translation of same).
Copy of Japanese Examination Report dated Feb. 3, 2004 (and English translation of same).

* cited by examiner

*Primary Examiner*—Robert Pascal
*Assistant Examiner*—Kimberly Glenn
(74) *Attorney, Agent, or Firm*—Dickstein, Shapiro, Morin & Oshinsky, LLP.

(57) ABSTRACT

A dielectric filter and a dielectric duplexer have structures for coupling between resonators, in which a range for determining the coupling strength between the resonators can be broadened and the polarity of the coupling can be changed. In addition, a communication apparatus incorporating the dielectric filter or the dielectric duplexer can be provided. Inside a dielectric member, resonance line holes having resonance lines formed on the inner surfaces thereof are disposed. Both ends of each of the resonance line holes are open-circuited. The inner diameter of each of the resonance line holes is changed at some point in the longitudinal direction of each resonance line to form a stepped part.

19 Claims, 11 Drawing Sheets

FIG. 10
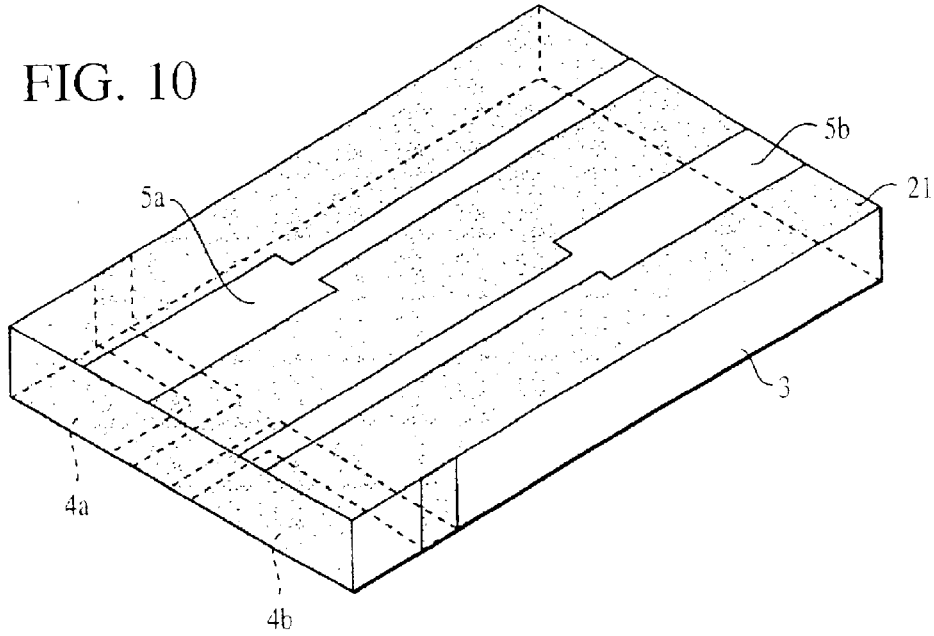
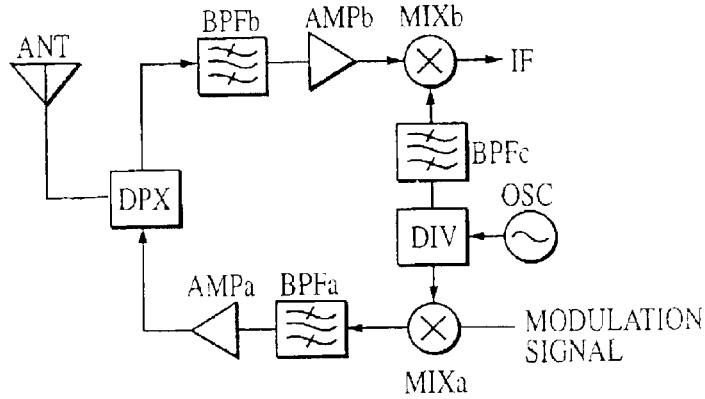
FIG. 11

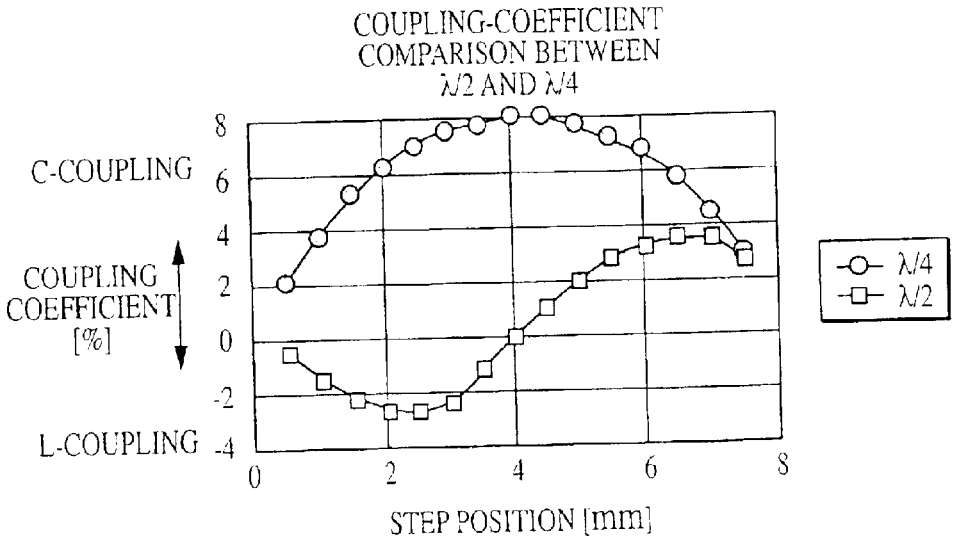
FIG. 12
FIG. 13
PRIOR ART
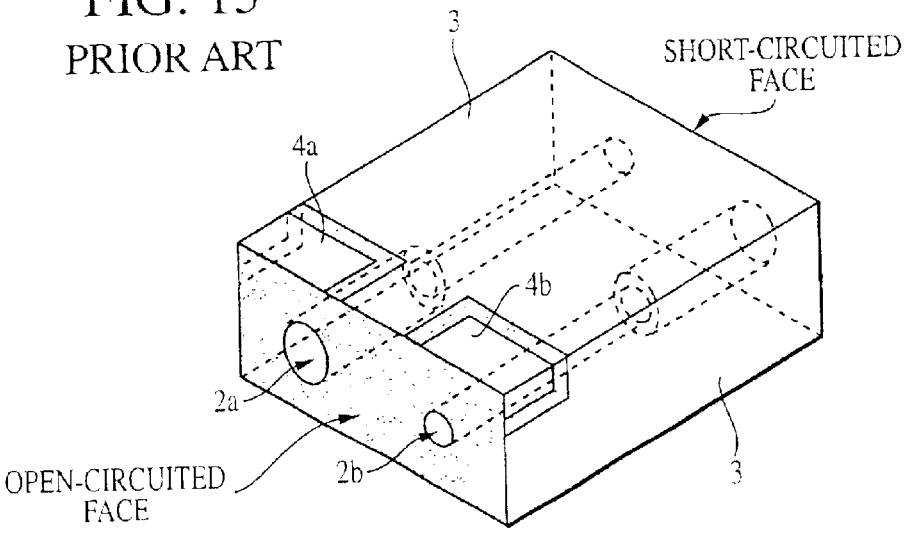

DIELECTRIC FILTER, DIELECTRIC DUPLEXER, AND COMMUNICATION APPARATUS INCORPORATING THE SAME

CROSS REFERENCE TO RELATED APPLICATIONS

This is a continuation of U.S. patent application Ser. No. 09/687,903, filed Oct. 13, 2000 in the name of Hideki Tsukamoto et al.

BACKGROUND OF THE INVENTION

1. Field of the Invention

The present invention relates to dielectric filters, dielectric duplexers, and communication apparatuses incorporating the same.

2. Description of the Related Art

A coaxial composite dielectric filter is a conventional type of bandpass filter used in microwave bands. The coaxial composite dielectric filter is formed by arranging a plurality of resonance line holes having resonance lines formed on the inner surfaces thereof in a dielectric block and forming an outer conductor on the outer surfaces of the dielectric block.

Particularly, Japanese Unexamined Patent Application Publication No. 2-92001 discloses a dielectric filter in which the inner diameter of each of the resonance line holes is changed at a position in the axial direction of each resonance line hole to form a stepped part.

For example, a conventional dielectric filter having a stepped part formed by changing the inner diameter of each of the resonance line holes is shown in FIG. 13. FIG. 13 shows a perspective view of the dielectric filter, in which the top surface is the surface used when the dielectric filter is mounted on a circuit board. In this figure, the reference numeral 1 denotes a substantially rectangular-parallelepiped dielectric block, inside which resonance line holes 2*a* and 2*b* are formed. The resonance line holes 2*a* and 2*b* are through-holes penetrating two substantially parallel opposing surfaces of the dielectric block 1. The inner diameter of each of the through-holes is changed at a specified position in the axial direction of each of the holes to form a stepped part. An inner conductor is disposed on the inner surface of each of the resonance line holes 2*a* and 2*b* to form a respective resonance line. In addition, an outer conductor 3 is disposed on five surfaces of the dielectric block 1 and connected to the resonance line holes 2*a* and 2*b* except on one of the surfaces where the resonance lines are open-circuited. On outer surfaces of the dielectric block 1, terminal electrodes 4*a* and 4*b* separated from the outer conductor 3 are formed. A capacitance is formed between the terminal electrodes 4*a* and 4*b* and parts near the open-circuited ends of the resonance lines to make capacitive coupling.

In this way, in the dielectric block 1, one of the opening ends of each resonance line hole is a short-circuited end, and the other opening end thereof is an open-circuited end, to constitute a ¼-wavelength resonator.

In the above dielectric filter, while maintaining the axial length of each of the resonance line holes fixed, the resonance frequency of a resonance element formed by each resonance line hole can be adjusted to a desired value.

However, although the strength of the capacitive coupling between the adjacent resonators can be adjusted by changing the position of the stepped part in the axial direction, it is impossible to change the capacitive coupling to inductive coupling, that is, it is impossible to change the polarity of coupling.

SUMMARY OF THE INVENTION

Accordingly, the present invention provides a dielectric filter and a dielectric duplexer having coupling structures between resonators, in which the variable range of coupling strength is broadened and the polarity of coupling can be changed. The present invention further provides a communication apparatus incorporating one of the dielectric filter and the dielectric duplexer.

According to a first aspect of the invention, there is provided a dielectric filter including a plurality of resonance lines substantially parallel to each other arranged on an upper surface of a dielectric substrate or inside a dielectric block, and an outer conductor formed on the lower surface of the dielectric substrate or on the outer surface of the dielectric block. In the dielectric filter, both ends of each of the plurality of resonance lines or parts near both ends thereof are open-circuited, and the width of at least one of the resonance lines is changed in at least one position in the longitudinal direction of the resonance line to form a stepped part.

According to a second aspect of the invention, there is provided a dielectric duplexer including a pair of dielectric filters of the type described above, formed on a single dielectric plate or inside a single dielectric block to be used as a transmitting side filter and a receiving side filter, respectively. A transmitted-signal input terminal is coupled to a first-stage resonance line of the transmitting side filter, a received-signal output terminal is coupled to a last-stage resonance line of the receiving side filter, and an antenna terminal is coupled in common to both a last-stage resonance line of the transmitting side filter and a first-stage resonance line of the receiving side filter.

In addition, according to a third aspect of the invention, there is provided a communication apparatus including one of the dielectric filter and the dielectric duplexer, which may be used either as a filter or as a duplexer for transmitting/receiving signals in a high-frequency circuit.

The foregoing and other features and advantages of the invention will be appreciated from the following detailed description of embodiments thereof, with reference to the drawings, in which like references denote like elements and parts.

BRIEF DESCRIPTION OF THE DRAWINGS

FIG. 10 is a structural view of a dielectric filter according to a tenth embodiment of the present invention;

FIG. 11 is a structural view of a communication apparatus according to an eleventh embodiment of the present invention;

FIG. 12 is a graph showing the relationships between the positions of stepped parts and the coupling coefficients of a half-wavelength resonator and a ¼-wavelength resonator; and FIG. 13 is a view showing a structural example of a conventional dielectric filter.

DESCRIPTION OF EMBODIMENTS OF THE INVENTION

A description will be given of the structure of a dielectric filter according to a first embodiment of the present invention with reference to FIGS. 1A and 1B.

Figure 1A:
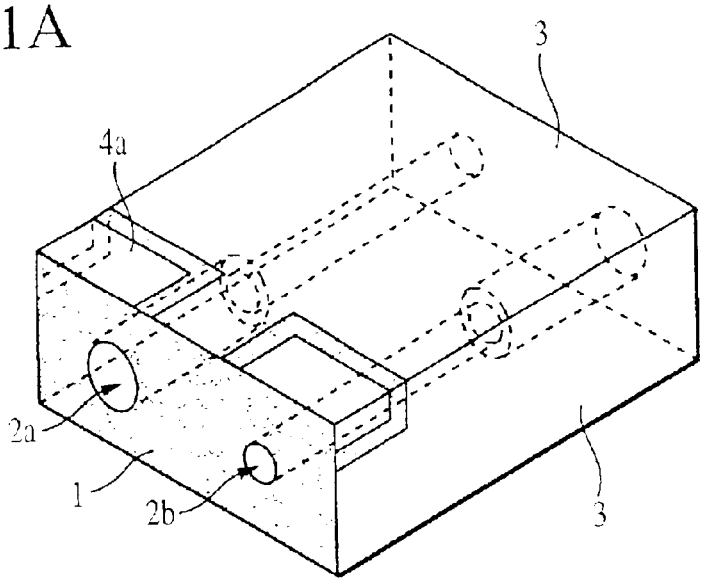
FIGS. 1A and 1B are structural views of a dielectric filter according to a first embodiment of the present invention.

FIG. 1A shows a perspective view of the dielectric filter, in which the top surface is the surface to be mounted on a circuit board. FIG. 1B shows a sectional view taken along a plane parallel to the mounting surface. In this figure, the reference numeral 1 denotes a substantially rectangular-parallelepiped dielectric block, inside which resonance line holes 2*a* and 2*b* are formed. The resonance line holes 2*a* and 2*b* are through-holes penetrating two substantially parallel opposing end surfaces of the dielectric block 1. The inner diameter of each of the through-holes 2*a* and 2*b* is changed at a specified position in the axial direction of the holes to form a stepped part. Hereinafter, the small inner-diameter part is referred to as a small diameter part and the large inner-diameter part is referred to as a large diameter part. By disposing inner conductors on the inner surfaces of the resonance line holes 2*a* and 2*b*, resonance lines 5*a* and 5*b* are formed. In addition, an outer conductor 3 is formed on the four side surfaces and not on the end surfaces of the dielectric block 1. On outer surfaces of the dielectric block 1, terminal electrodes 4*a* and 4*b* separated from the outer conductor 3 are formed. The terminal electrodes 4*a* and 4*b* and parts of the resonance lines 5*a* and 5*b* near one of the end surfaces form a capacitive coupling.

In this way, two half-wavelength resonators are formed by the dielectric material of the dielectric block, the resonance lines 5*a* and 5*b* disposed in the dielectric block, and the outer conductor 3.

Figure 1B:
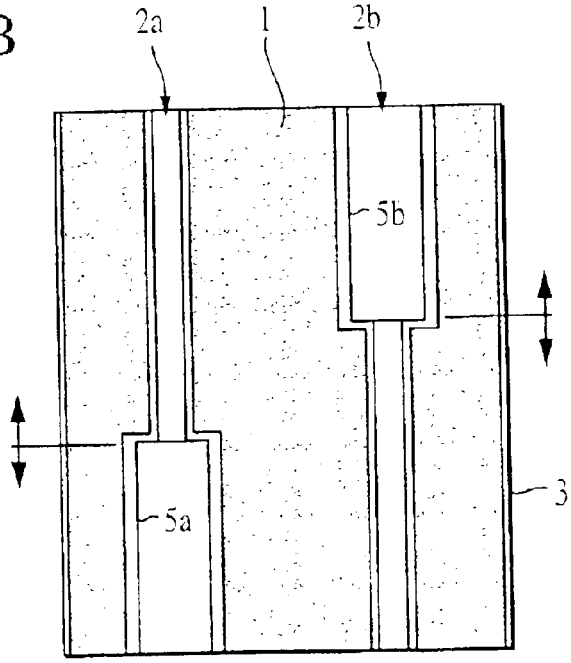

FIG. 12 shows the relationships between the positions of the stepped parts and the coupling coefficients between resonators of the half-wavelength resonator formed of the resonance line having the stepped part as shown in FIGS. 1A and 1B (hereinafter referred to as step position, and the conventional ¼-wavelength resonator formed of the resonance line having the stepped part as shown in FIG. 13. In this case, the step position is defined by the length of the small diameter part, and the lengths of the small diameter parts of the two resonance line holes are set to be equal.

In the conventional ¼-wavelength resonator, when the step position is changed sequentially from the vicinity of the short-circuited end to the vicinity of the open-circuited end, the characteristic impedance of a part closer to the open-circuited end and the characteristic impedance of a part closer to the short-circuited end relatively change, whereby the coupling coefficient between the resonators changes. However, the change always relates to capacitive coupling.

In contrast, in the half-wavelength resonator as shown in FIGS. 1A and 1B, the vicinities of both ends of each resonance line are open-circuited ends and the vicinity of the center of each line is equivalent to a short-circuited end. Thus, when the step positions are gradually changed in such a manner that the lengths of the small diameters are gradually increased, the relative changes between the characteristic impedance of the parts near the open-circuited ends and the characteristic impedance near the short-circuited end change over the range of positive and negative polarities. That is, when the length of the small diameter part is shorter than that of the large diameter part, inductive coupling (L coupling) occurs. When the length of the small diameter part is longer than that of the large diameter part, capacitive coupling (C coupling) occurs. With this arrangement, freedom of design is greatly increased.

Next, the structure of a dielectric filter according to a second embodiment of the present invention will be illustrated with reference to FIGS. 2A to 2C.

Figure 2A:
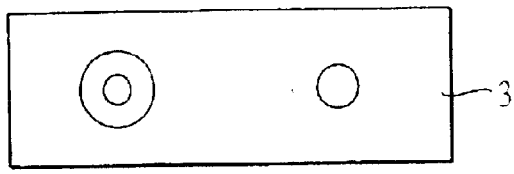
FIGS. 2A, 2B, and 2C are structural views of a dielectric filter according to a second embodiment of the present invention.
Figure 2B:
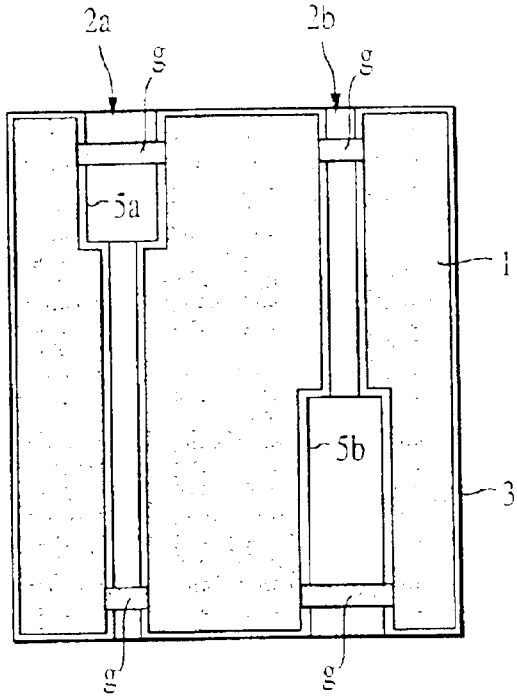
Figure 2C:
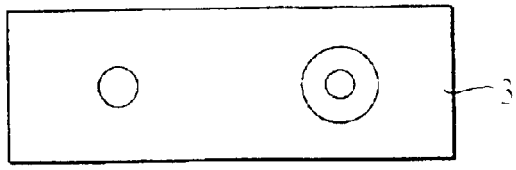

FIG. 2A shows a back view of the dielectric filter, FIG. 2B shows a sectional view taken along a plane parallel to the mounting surface of the dielectric filter, and FIG. 2C shows a front view of the dielectric filter. Unlike the example shown in FIGS. 1A and 1B, an outer conductor 3 is also formed on the dielectric block at the two opening ends of resonance line holes 2*a* and 2*b*. Inside the resonance line holes near the opening ends, electrodeless portions g are formed, whereby a stray capacitance is generated at each of the electrodeless portions g. This arrangement provides a structure in which a capacitance is connected between both ends of each of the resonance lines 5*a* and 5*b* and ground. As a result, the two resonators have electromagnetic-field coupling.

Figure 3A:
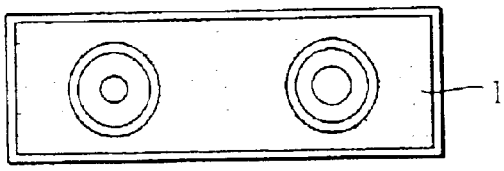
FIGS. 3A, 3B, and 3C are structural views of a dielectric filter according to a third embodiment of the present invention.
Figure 3B:
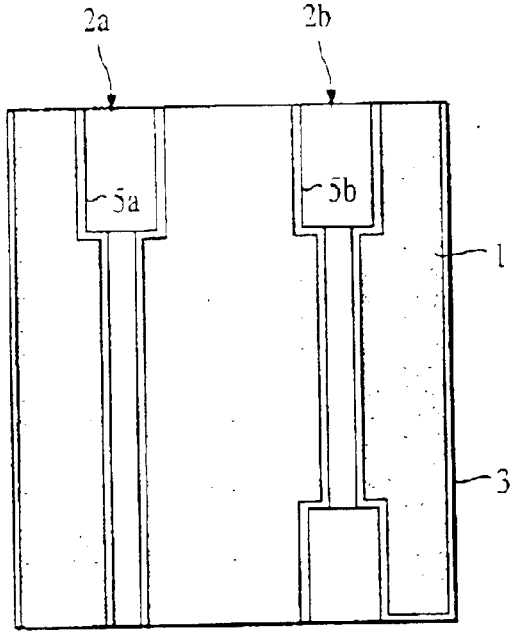
Figure 3C:
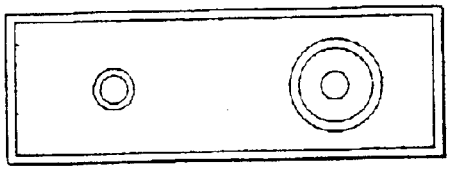

FIGS. 3A, 3B, and 3C are views showing the structure of a dielectric filter according to a third embodiment of the present invention. FIG. 3A is a back view of the dielectric filter, FIG. 3B is a sectional view taken along a plane parallel to a surface to be mounted, and FIG. 3C is a front view of the dielectric filter. Unlike the example shown in FIGS. 1A and 1B, a resonance line hole 2*b* has stepped parts in two positions in the axial direction thereof. In this way, by widening the inner diameters near both open-circuited ends of the resonance line hole 2*b*, the resonance frequency of a resonance line 5*b* is lowered, and the capacitive coupling between resonators can be enhanced.

Figure 4A:
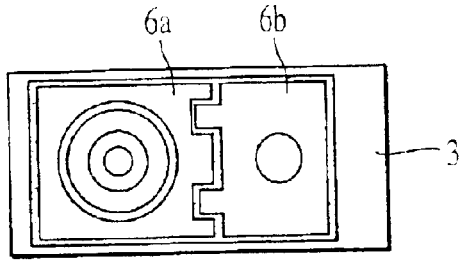
FIGS. 4A, 4B, and 4C are structural views of a dielectric filter according to a fourth embodiment of the present invention.
Figure 4B:
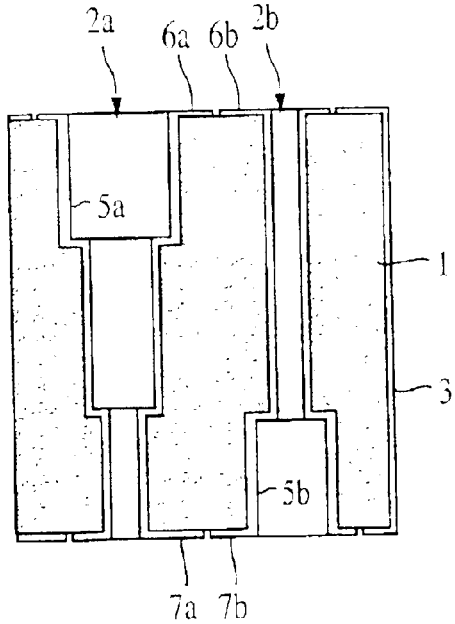
Figure 4C:
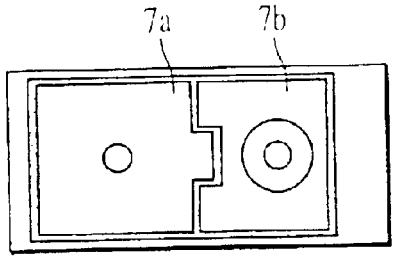

FIGS. 4A, 4B, and 4C are views showing the structure of a dielectric filter according to a fourth embodiment of the present invention. FIG. 4A is a back view of the dielectric filter, FIG. 4B is a sectional view taken along a plane parallel to a surface to be mounted, and FIG. 4C is a front view of the dielectric filter.

In this example, at the opening ends of the resonance line holes 2*a* and 2*b* are formed coupling electrodes 6*a* and 7*a* and coupling electrodes 6*b* and 7*b* which are conductively connected to resonance lines 5*a* and 5*b*, respectively. A capacitance is generated between the coupling electrodes 6*a* and 6*b*, and a capacitance is also generated between the coupling electrodes 7*a* and 7*b*. With this arrangement, the capacitive coupling between the two resonators is increased.

Furthermore, in the embodiment shown in FIGS. 4A to 4C, the inner diameter of the resonance line hole 2*a* is changed in two stages. With this arrangement, since the amount of change in the coupling coefficient with respect to the step position is reduced, an advantage can be obtained in which the variations in coupling strength due to varying accuracy in the formation of a dielectric block can be reduced.

Figure 5A:
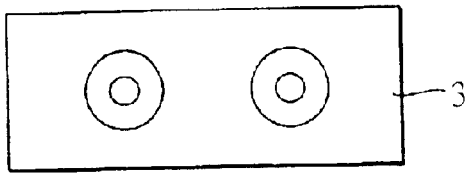
FIGS. 5A, 5B, and 5C are structural views of a dielectric filter according to a fifth embodiment of the present invention.
Figure 5B:
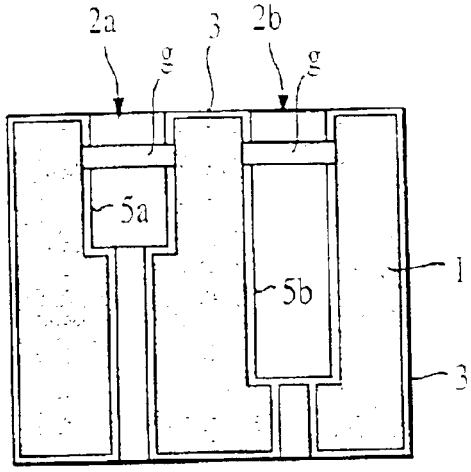
Figure 5C:
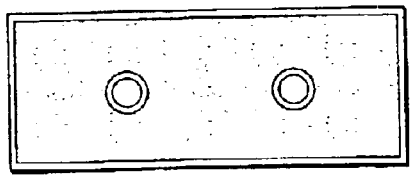

FIGS. 5A, 5B, and 5C are views showing the structure of a dielectric filter according to a fifth embodiment of the present invention. In this embodiment, an outer conductor 3 is disposed on the dielectric block at one opening end of each of the resonance line holes 2*a* and 2*b*. Electrodeless portions g are formed on the inner surfaces of the resonance line holes 2*a* and 2*b* near that opening end. On the other opening ends thereof, no outer conductor 3 is disposed, so the other opening ends are open-circuited.

In this way, when one of the opening ends of each resonance line hole is an open-circuited end, and a stray capacitance is formed at the other opening end thereof, the resonance lines similarly serve as half-wavelength resonators.

In addition, as another embodiment, at one of the opening ends of each resonance line hole, a coupling electrode as shown in FIGS. 4A to 4C may be formed, and a stray capacitance generated by an electrodeless portion may be formed near the other opening end of each resonance line hole.

Figure 6A:
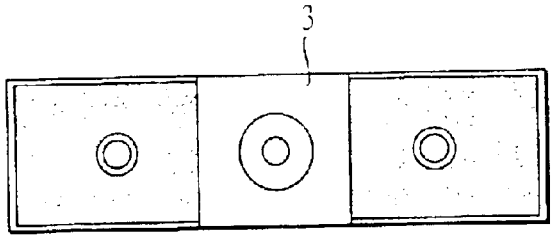
FIGS. 6A, 6B, and 6C are structural views of a dielectric filter according to a sixth embodiment of the present invention.
Figure 6B:
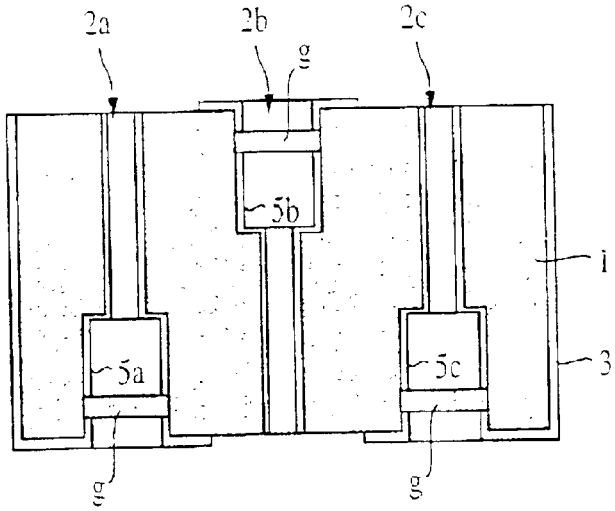
Figure 6C:
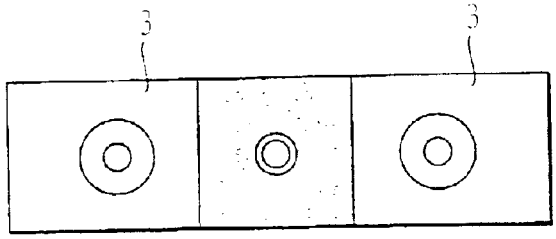

FIGS. 6A, 6B, and 6C are views showing the structure of a dielectric filter according to a sixth embodiment of the present invention. FIG. 6A is a back view of the dielectric filter, FIG. 6B is a sectional view taken at a plane parallel to a surface to be mounted, and FIG. 6C is a front view of the dielectric filter.

In this embodiment, inside a dielectric block 1, three resonance line holes 2*a*, 2*b*, and 2*c* are disposed. One of the opening ends of each of the resonance line holes 2*a*, 2*b*, and 2*c* is an open-circuited end, and an electrodeless portion g is disposed near the other opening end. The directions of the resonance line holes 2*a*, 2*b*, and 2*c* are alternately changed in such a manner that the open-circuited ends and electrodeless portion ends of the adjacent resonance line holes are opposed to each other. This arrangement increases the level of freedom in changing the pitch between the resonators. For example, it is possible to bring the large diameter parts of the resonance line holes 2*a* and 2*c* close to the small diameter part of the resonance line hole 2*b* to narrow the gap between the central axes of the resonance line holes 2*a*, 2*b*, and 2*c*, that is, the pitches among the resonators. In addition, the characteristics of the filter can be easily adjusted by cutting the respective electrodeless portions g of the resonance line holes via the corresponding large-diameter opening ends of the resonance line holes.

In FIGS. 6A, 6B, and 6C, on outer surfaces of the dielectric block 1, terminal electrodes are formed to generate a capacitance between the terminal electrodes and parts near the electrodeless portions g of the resonance lines 5*a* and 5*c*. These terminal electrodes are used as an input terminal and an output terminal. With such an arrangement, a dielectric filter showing band pass characteristics formed of three resonators can be obtained.

Next, as a seventh embodiment, an example of a dielectric duplexer will be illustrated with reference to FIGS. 7A, 7B, and 7C.

Figure 7A:
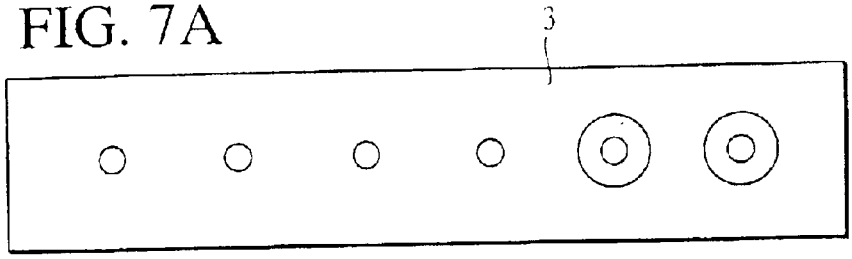
FIGS. 7A, 7B, and 7C are structural views of a dielectric duplexer according to a seventh embodiment of the present invention.
Figure 7B:
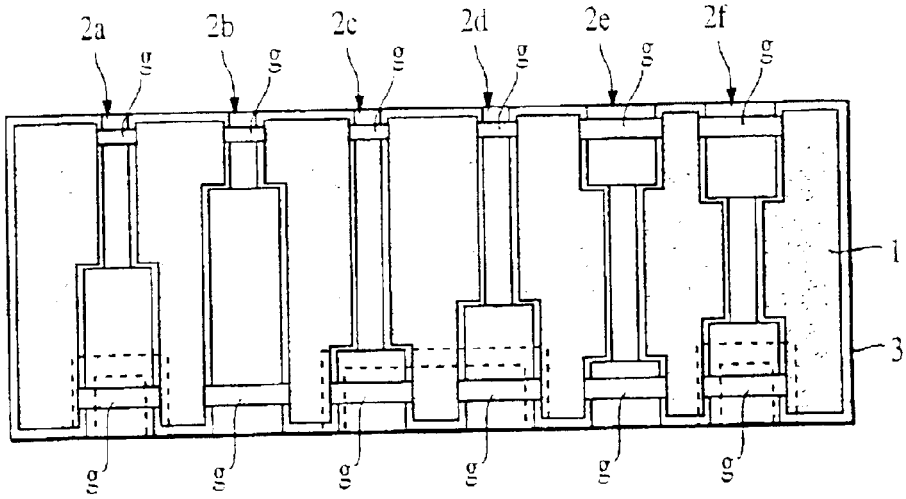
Figure 7C:
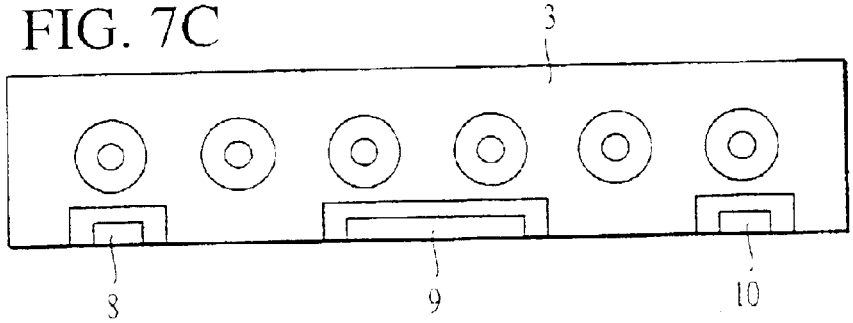

FIG. 7A shows a back view of the dielectric filter, FIG. 7B shows a sectional view taken at a plane parallel to a circuit board mounting surface, and FIG. 7C shows a front view of the dielectric filter. Inside a dielectric block 1, resonance line holes 2*a* to 2*f* are formed. The diameter of a specified part of each of the resonance line holes 2*a* to 2*f* is changed, and an electrodeless portion g is disposed near each of the opening ends of the resonance line holes. On the six outer surfaces of the dielectric block 1, an outer conductor 3 is formed. In addition, on some outer surfaces of the dielectric block 1 are formed terminal electrodes 8, 9, and 10. The terminal electrodes 8 and 10 generate a capacitance between them and parts near one of the open-circuited ends of the resonance line holes 2*a* and 2*f*, respectively. In addition, the terminal electrode 9 is formed to generate a capacitance between the electrode 9 and parts near one of the open-circuited ends of the resonance line holes 2*c* and 2*d*.

In this way, the three resonators formed by the resonator line holes 2*a*, 2*b*, and 2*c* constitute a transmitting side filter having band pass filter characteristics. In addition, similarly, the three resonators formed by the resonance line holes 2*d*, 2*e*, and 2*f* constitute a receiving side filter having band pass characteristics. The terminal electrode 8 is used as a Tx terminal, the terminal electrode 9 is used as an ANT terminal, and the terminal electrode 10 is used as an Rx terminal.

Figure 8A:
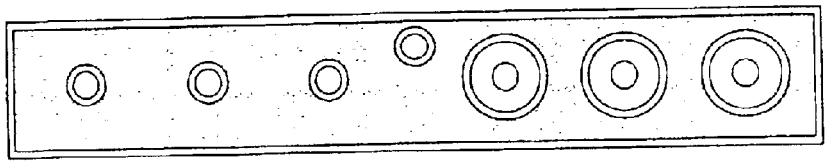
FIGS. 8A, 8B, and 8C are structural views of a dielectric duplexer according to an eighth embodiment of the present invention.
Figure 8B:
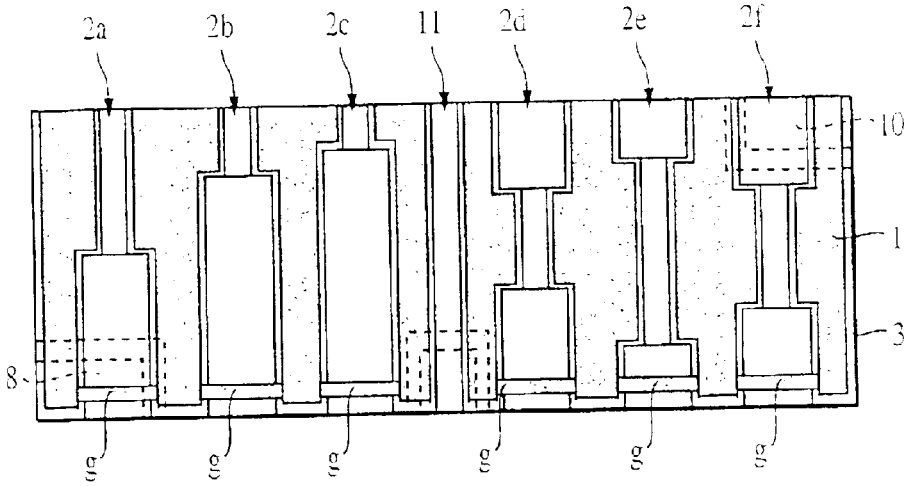
Figure 8C:
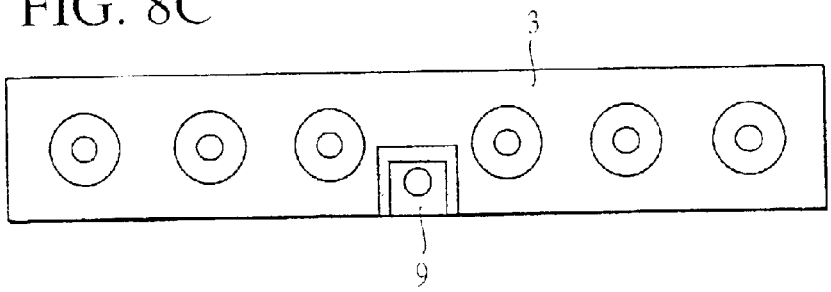

FIGS. 8A, 8B, and 8C are views showing the structure of a dielectric duplexer according to an eighth embodiment of the present invention. FIG. 8A is a back view of the dielectric duplexer, FIG. 8B is a sectional view taken at a plane parallel to a circuit board mounting surface, and FIG. 8C is a front view of the dielectric duplexer. In this embodiment, inside a dielectric block 1, in addition to resonance line holes 2*a* to 2*f*, a coupling line hole 11 is formed. The coupling line hole 11 couples to resonators formed by the adjacent resonance line holes 2*c* and 2*d*. On one of the opening ends of the coupling line hole 11, a terminal electrode 9 connected to the inner-surface electrode of the coupling line hole 11 is formed. One opening end of each of the resonance line holes 2*a* to 2*f* is an open-circuited end, and an electrodeless portion is disposed near the other opening end thereof.

On outer surfaces of the dielectric block, a terminal electrode 8 is formed to generate a capacitance between the terminal electrode 8 and a part near the electrodeless portion at the open-circuited end of the resonance line hole 2*a*, and a terminal electrode 10 is formed to generate a capacitance between the terminal electrode 10 and a part near either one of the open-circuited ends of the resonance line hole 2*f*.

In this way, three resonators formed by the resonance line holes 2*a*, 2*b*, and 2*c* constitute a transmitting side filter having band pass filter characteristics. Similarly, the three resonators formed by the resonance line holes 2*d*, 2*e*, and 2*f* constitute a receiving side filter having the band pass characteristics. The terminal electrode 8 is used as a Tx terminal, the terminal electrode 9 is used as an ANT terminal, and the terminal electrode 10 is used as an Rx terminal.

Figure 9A:
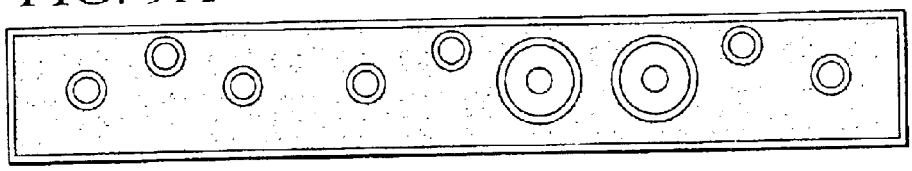
FIGS. 9A, 9B, and 9C are structural views of a dielectric duplexer according to a ninth embodiment of the present invention.
Figure 9B:
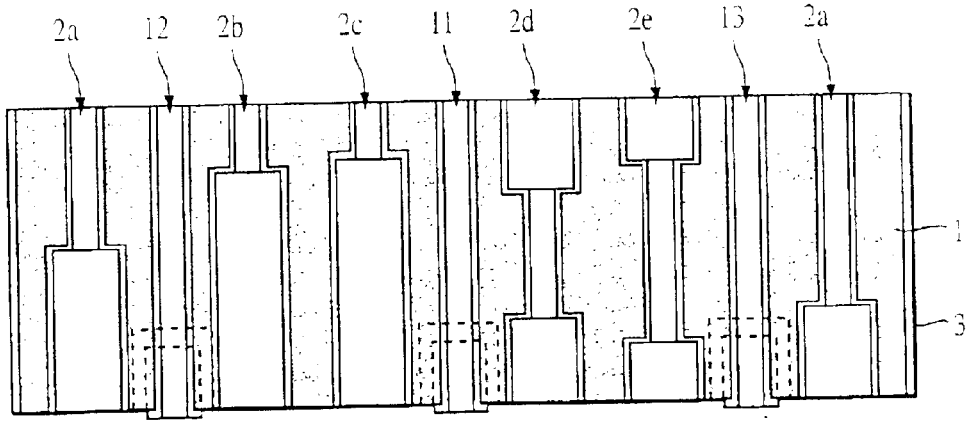
Figure 9C:
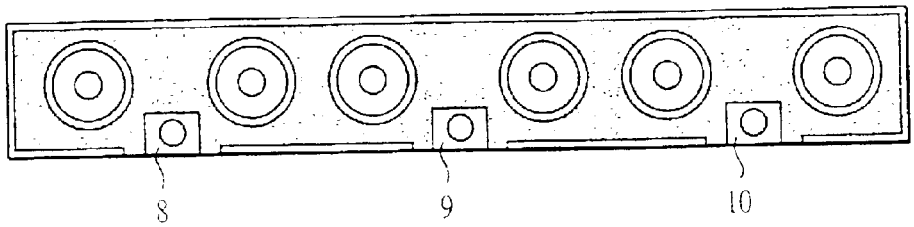

FIGS. 9A, 9B, and 9C are views showing the structures of a dielectric duplexer according to a ninth embodiment of the present invention. FIG. 9A is a back view of the dielectric duplexer. FIG. 9B is a sectional view taken at a plane penetrating the resonance line holes and the coupling line holes inside a dielectric block 1. FIG. 9C is a front view of the dielectric duplexer. In this embodiment, inside the dielectric block 1, resonance line holes 2*a* to 2*f* and coupling line holes 11 to 13 are formed. Opening ends of each of the resonance line holes 2*a* to 2*f* are open-circuited ends. One opening end of each of the coupling line holes 11 to 13 is an open-circuited end, and, at the other opening end thereof are terminal electrodes 8, 9, and 10 which are connected to the inner surface electrode of the holes 11 to 13.

The coupling line hole 11 couples to the adjacent resonance line holes 2*c* and 2*d*. The inner electrode of the resonance line hole 12 couples to the resonance lines of the adjacent resonance line holes 2*a* and 2*b*. In addition, the inner electrode of the coupling line hole 13 couples to the resonance lines of the adjacent resonance line holes 2*e* and 2*f*. In this embodiment, the resonators formed by the resonance line holes 2*a* and 2*f* are used as trap resonators. The two resonators formed by the resonance line holes 2*b* and 2*c* are used as a transmitting side filter. The two resonators formed by the resonance line holes 2*d* and 2*e* are used as a receiving side filter. The resonance frequency of the trap resonator formed by the resonance line hole 2*a* is set to be a frequency within a reception band or a frequency adjacent to the reception band. The resonance frequency of the trap resonator formed by the resonance line hole 2*f* is set to be a frequency within a transmission band or a frequency adjacent to the transmission band. The terminal electrode 8 is used as a Tx terminal, the terminal electrode 9 is used as an ANT terminal, and the terminal electrode 10 is used as an Rx terminal.

Next, the structure of the dielectric filter according to a tenth embodiment of the present invention will be illustrated with reference to FIG. 10. In each of the above-described embodiments, the resonance lines are disposed inside the dielectric block. However, it is also possible to constitute a dielectric filter by forming resonance lines on a dielectric plate. This case is applied to the tenth embodiment.

In FIG. 10, the reference numeral 21 denotes a dielectric plate. On the upper surface of the dielectric plate 21, resonance lines 5*a* and 5*b* are formed. The widths of the resonance lines 5*a* and 5*b* are changed at specified positions in the longitudinal directions of the resonance lines 5*a* and 5*b* to form stepped parts. An outer conductor 3 is formed on the lower surface of the dielectric plate 21 and the side surfaces thereof parallel to the resonance lines 5*a* and 5*b*. In addition, on outer surfaces of the dielectric block 1, terminal electrodes 4*a* and 4*b* separated from the outer conductor 3 are formed. These terminal electrodes 4*a* and 4*b* form a capacitance between them and parts near one of the open-circuited ends of the resonance lines 5*a* and 5*b* to make capacitive coupling.

In this way, the dielectric plate 21, the resonance lines 5*a* and 5*b*, and the outer conductor 3 constitute two half-wavelength resonators.

In FIG. 10, the dielectric filter of the structure shown in each of FIGS. 1A and 1B is modified into a dielectric filter using a dielectric plate. Similarly, any of the dielectric filters and the dielectric duplexers shown in FIGS. 2 to 9 may be modified into filters and duplexers incorporating dielectric plates.

Next, the structure of a communication apparatus according to an eleventh embodiment of the present invention will be illustrated with reference to FIG. 11.

In this figure, the reference character ANT denotes a transmission/reception antenna, the reference character DPX denotes a duplexer, the reference characters BPFa, BPFb, and BPFc denote band pass filters, the reference characters AMPa and AMPb denote amplifying circuits, the reference characters MIXa and MIXb denote mixers, the reference character OSC denotes an oscillator, and the reference character DIV denotes a frequency divider (synthesizer). The MIXa modulates a frequency signal output from the DIV by a modulation signal. The BPFa passes only the signal of a transmission frequency band, and the AMPa power-amplifies the signal to transmit from the ANT via the DPX. The BPFb passes only the signal of a reception frequency band among signals output from the DPX, and the AMPb amplifies the passed signal. The MIXb mixes a frequency signal output from the BPFc and the received signal to output an intermediate frequency signal IF.

As the duplexer DPX shown in FIG. 11, a duplexer having the structure shown in each of FIGS. 7 to 9 can be used. In addition, as the band pass filters BPFa, BPFb, and BPFc, the dielectric filter having the structure shown in one of FIGS. 1A to 6C and FIG. 10 can be used.

According to the present invention, since coupling strength can be set in a broad range in which the polarity of coupling between resonance lines changes, freedom of design can be increased, with the result that a dielectric filter having desired characteristics can be easily made.

In addition, with the use of the single dielectric block, an antenna duplexer having desired filter characteristics of both the transmitting side filter and the receiving side filter can be formed.

In addition, by using one of the dielectric filter and the dielectric duplexer having the desired filter characteristics, a communication apparatus showing good high-frequency circuit characteristics can be obtained.

While the preferred embodiments of the present invention have been described above, it is to be understood that modifications will be apparent to those skilled in the art without departing from the spirit and scope of the following claims.

What is claimed is:

1. A dielectric filter, comprising:

a dielectric substrate having a substantially planar upper surface, an opposing lower surface and first and second end surfaces extending between the upper and lower surfaces;

an outer conductor formed on at least the lower surface of the dielectric substrate;

a plurality of resonance lines, each of the resonance lines:

being located on the upper surface of the dielectric substrate;

extending from the first end surface to the second end surface of the dielectric substrate; and having opposite open circuit ends at the end surfaces of the dielectric substrate;

at least one resonance line of the plurality of resonance lines having at least one stepped part located between its open circuit ends, the at least one stepped part defined by at least a first width portion and a second width portion, the first width portion having a width smaller than that of the second width portion, wherein when a length of the first width portion is shorter than a length of the second width portion inductive coupling occurs, and when the length of the first width portion is longer than the length of the second width portion capacitive coupling occurs.

2. The dielectric filter of claim 1, wherein at least one of the resonance lines has two stepped parts located between its open circuit ends.

3. The dielectric filter of claim 2, wherein the stepped parts of the at least one resonance line are defined by a portion that has a first width and two other portions that have respective widths which are smaller than the first width.

4. The dielectric filter of claim 1, wherein the resonance lines are parallel to one another.

5. A dielectric filter comprising:

a dielectric substrate having a substantially planar upper surface, an opposing lower surface and first and second end surfaces extending between the upper and lower surfaces;

an outer conductor formed on at least the lower surface of the dielectric substrate;

a plurality of resonance lines, each of the resonance lines:
being located on the upper surface of the dielectric substrate;
extending from the first end surface to the second end surface of the dielectric substrate; and
having opposite open circuit ends at the end surfaces of the dielectric substrate, wherein at least one of the resonance lines has only one stepped part located between its open circuit ends.

6. A communication apparatus comprising a high-frequency circuit which includes at least one of a transmitting circuit and a receiving circuit, wherein said high-frequency circuit includes a dielectric filter comprising:

a dielectric substrate having a substantially planar upper surface, an opposing lower surface and first and second end surfaces extending between the upper and lower surfaces;

an outer conductor formed on at least the lower surface of the dielectric substrate; and a plurality of resonance lines, each of the resonance lines:
being located on the upper surface of the dielectric substrate;
extending from the first end surface to the second end surface of the dielectric substrate; and
having opposite open circuit ends at the end surfaces of the dielectric substrate;

at least one resonance line of the plurality of resonance lines having at least one stepped part located between its open circuit ends, the at least one stepped part defined by at least a first width portion and a second width portion, the first width portion having a width smaller than that of the second width portion, wherein when a length of the first width portion is shorter than a length of the second width portion inductive coupling occurs, and when the length of the first width portion is longer than the length of the second width portion capacitive coupling occurs.

7. The communication apparatus of claim 6, wherein at least one of the resonance lines has two stepped parts located between its open circuit ends.

8. The communication apparatus of claim 7, wherein the stepped parts of the at least one resonance line are defined by a portion that has a first width and two other portions that have widths which are smaller than the first width.

9. The communication apparatus of claim 6, wherein the resonance lines are parallel to one another.

10. A communication apparatus comprising a high-frequency circuit which includes at least one of a transmitting circuit and a receiving circuit, wherein said high-frequency circuit includes a dielectric filter comprising:

a dielectric substrate having a substantially planar upper surface, an opposing lower surface and first and second end surfaces extending between the upper and lower surfaces;

an outer conductor formed on at least the lower surface of the dielectric substrate;

a plurality of resonance lines, each of the resonance lines:
being located on the upper surface of the dielectric substrate;
extending from the first end surface to the second end surface of the dielectric substrate; and
having opposite open circuit ends at the end surfaces of the dielectric substrate, wherein at least one of the resonance lines has only one stepped part located between its open circuit ends.

11. A dielectric filter, comprising:

a dielectric block having first and second opposed end surfaces and at least top and bottom surfaces extending between the opposed end surfaces;

an outer conductor formed on at least the bottom surface of the dielectric block;

a plurality of resonance line holes formed in the dielectric block and extending from the first to the second opposite end surfaces thereof so that one end of the resonance line holes terminate at the one of the end surfaces and the other end of the resonance line holes terminate at the other of the end surfaces; and a respective inner conductor formed on each of the resonance line holes to form respective resonators having open circuits at opposite ends thereof, at least one of the resonance line holes having a first diameter portion and a second diameter portion between the two ends thereof which form at least one stepped part, the first diameter portion having a diameter smaller than that of the second diameter portion, wherein when a length of the first diameter portion is shorter than a length of the second diameter portion inductive coupling occurs, and when the length of the first diameter portion is longer than the length of the second diameter portion capacitive coupling occurs.

12. The dielectric filter of claim 11, wherein the resonance line holes are parallel to one another.

13. The dielectric filter of claim 11, wherein at least one open circuit end of at least one of the resonators is defined by a gap formed in the inner conductor formed on its associated resonance line hole, the gap being spaced from both ends of its associated resonance line hole.

14. The dielectric filter of claim 11, wherein the diameter of each of at least two of the resonance line holes varies between the two ends thereof to form at least one step.

15. The dielectric filter of claim 14, wherein the step in one of the two resonance line holes is located near one of the end surfaces of the dielectric block and the step in the other of the two resonance line holes is located near the other end surface of the dielectric block.

16. The dielectric filter of claim 14, wherein the step in both of the resonance line holes are located near the same end surfaces of the dielectric block.

17. The dielectric filter of claim 11, wherein the diameter of each of at least three of the resonance line holes varies between the two ends thereof to form at least one step.

18. The dielectric filter of claim 17, wherein, the step formed in two of the resonance line holes is located near one end surface of the dielectric block and the step formed in the third of the resonance line holes is located near the second end of the dielectric block.

19. The dielectric filter of claim 11, wherein at least two of the resonance line holes are capacitively coupled to one another via a conductive plating formed on one of the end surfaces of the dielectric block.

* * * * *